US005575199A

United States Patent [19]

Yamamoto

[11] Patent Number: 5,575,199

[45] Date of Patent: Nov. 19, 1996

[54] COMPACTOR

[76] Inventor: Soichiro Yamamoto, 2 Allen Manner, Unionville, Ontario, Canada, L6C 1B2

[21] Appl. No.: 409,126

[22] Filed: Mar. 22, 1995

[51] Int. Cl.[6] ..... B65B 13/18; B30B 15/16; B30B 1/32

[52] U.S. Cl. ..... 100/34; 100/24; 100/53; 100/220; 100/255; 100/269.13

[58] Field of Search ..... 100/3, 24, 34, 100/53, 220, 229 R, 245, 255, 269.13, 269.19, 229 A; 141/73

[56] References Cited

U.S. PATENT DOCUMENTS

| | | | |
|---|---|---|---|
| 3,358,590 | 12/1967 | Howard | 100/229 A |
| 3,495,526 | 2/1970 | Mohler et al. | 100/229 R |
| 3,496,862 | 2/1970 | Sowerby | 100/229 R |
| 3,728,959 | 4/1973 | Fredrickson | 100/255 |
| 3,756,143 | 9/1973 | Hennels | 100/229 A |
| 3,827,348 | 8/1974 | Hennels | 100/255 |
| 3,861,297 | 1/1975 | Considine et al. | 100/53 |
| 3,862,595 | 1/1975 | Longo | 100/255 |
| 3,863,297 | 2/1975 | Simich | 100/34 |
| 3,945,313 | 3/1976 | Komberec et al. | 100/255 |
| 3,955,492 | 5/1976 | Topolay | 100/255 |
| 4,041,856 | 8/1977 | Fox . | |
| 4,073,228 | 2/1978 | Henzl | 100/53 |
| 4,311,092 | 1/1982 | Tea | 100/255 |
| 4,323,008 | 4/1982 | Tea | 100/255 |
| 4,512,252 | 4/1985 | Goldhammer | 100/53 |
| 5,044,271 | 9/1991 | Robbins et al. | 100/255 |
| 5,144,889 | 9/1992 | Alig et al. | 100/245 |

FOREIGN PATENT DOCUMENTS

| | | | |
|---|---|---|---|
| 335983 | 10/1930 | United Kingdom | 100/34 |

*Primary Examiner*—David Scherbel
*Assistant Examiner*—Tony G. Soohoo
*Attorney, Agent, or Firm*—Barrigar & Moss

[57] ABSTRACT

A compactor or baling machine as disclosed for compacting loose materials such as paper, plastic sheeting, rags and the like. The compactor includes a housing having an access door and a transverse platen located in the housing. Guide means are provided to guide the movement of the platen along a longitudinal path from a retracted position to an extended position. An actuator is located in the housing beside and parallel to the path of movement of the platen, the actuator having a first end attached to the housing and a second opposed end attached to the platen. Optional latch and interlock means automatically operate the platen and prevent the access door from opening unless the platen is stationary or in a retracted and safe position.

22 Claims, 12 Drawing Sheets

COMPACTOR

BACKGROUND OF THE INVENTION

This invention relates to baling machines or compactors for compacting waste material, such as paper, plastic sheeting, rags and the like.

DESCRIPTION OF THE PRIOR ART

Transportable compactors or baling machines have been produced in the past and they usually consist of a cabinet with one or more access doors, and a movable reciprocating platen located in the cabinet to compress or compact waste material located therein. The platen is usually reciprocated by one or more hydraulic or pneumatic cylinders mounted above the platen. An example of such a compactor is shown in U.S. Pat. No. 4,041,856 issued to Anthony Fox.

A difficulty with the prior art baling machines is that the cylinder or cylinders used to reciprocate the platen must be very large and heavy in order to develop the necessary compacting forces. This gives the baling machines a high center of gravity or makes them top heavy, with the result that they tip easily, or they have to be provided with a wide base which extends quite far laterally from the cabinet, with the result that the machines take up a large amount of floor space where they are used. While the actuating cylinders could be located in the bottom of the compacting machines to lower the centre of gravity and overcome the tipping problem, this is not feasible because waste material would get under the platen and jam or damage the operating mechanisms.

SUMMARY OF THE INVENTION

The baling machine of the present invention is very compact and has a low center of gravity in view of the fact that the actuator is mounted beside and parallel to the path of travel of the platen.

According to the invention, there is provided a compactor comprising an elongate housing including an access door. A transverse platen is located in the housing. Guide means is coupled to the platen for guiding the movement of the platen along a longitudinal path in the housing from a retracted position, past the access door to an extended position, whereby material inserted into the housing through the access door is compacted by the platen. Also, an actuator is located in the housing beside and parallel to the path of movement of the platen, the actuator having a first end attached to the housing and a second opposed end attached to the platen.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
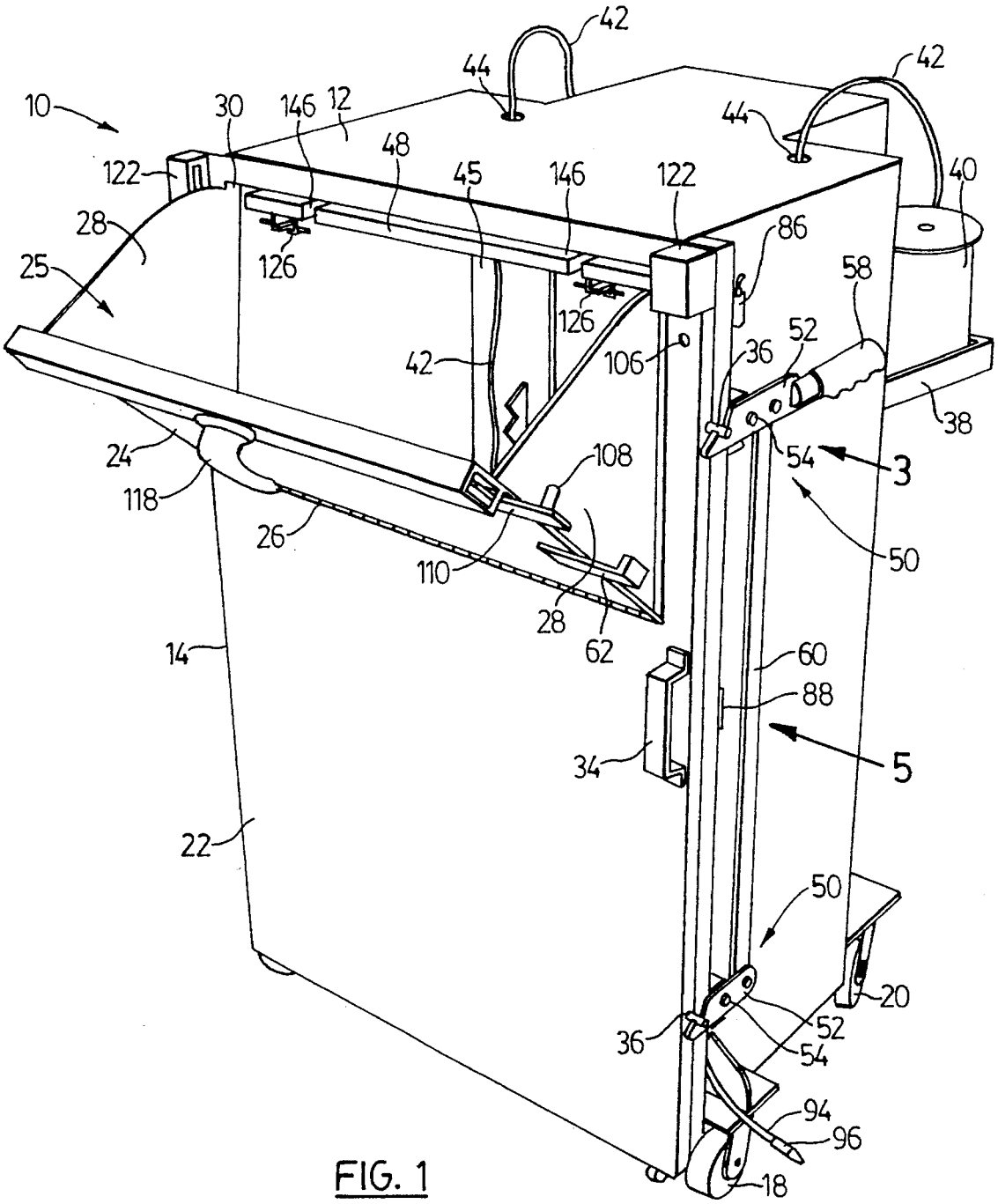
FIG. 1 is a perspective view of a preferred embodiment of a compactor according to the present invention, showing the access door closed but the loading hopper open.
Figure 2:
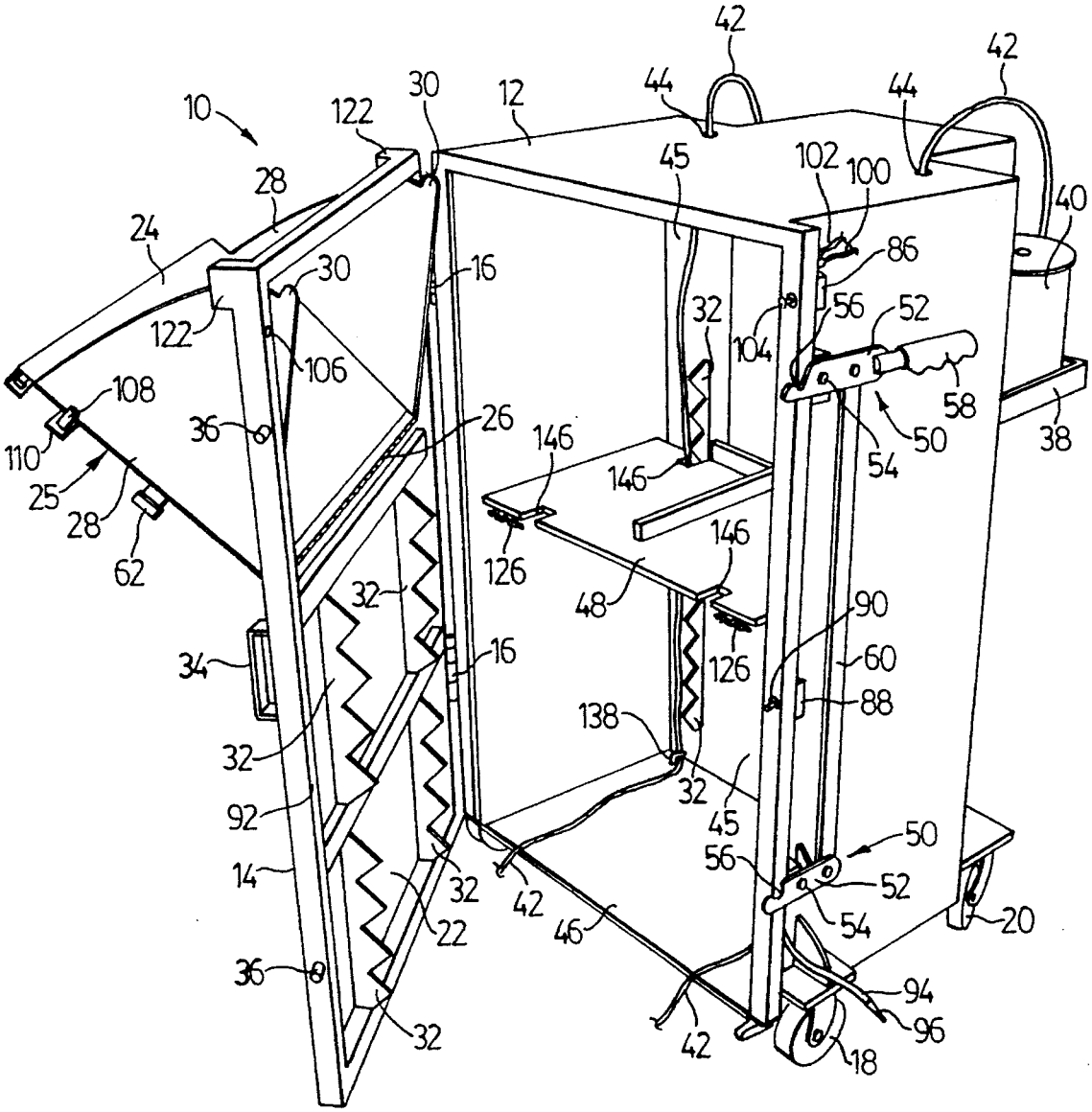
FIG. 2 is a perspective view similar to FIG. 1 but showing the access door open.

Referring firstly to FIGS. 1 and 2, a preferred embodiment of a baling machine or compactor according to the present invention is generally indicated by reference numeral 10. Compactor 10 includes an elongate, upright, cabinet or housing 12 with a front access door 14 pivotally or hingeably mounted in housing 12 using hinges 16. Castors 18, 20 are mounted on the lower end of housing 12 to make compactor 10 transportable. Castors 20, and also castors 18, if desired, are of the locking type, so that they can be locked to prevent compactor 10 from moving during use.

Access door 14 includes a lower main portion 22 and an upper inlet portion 24 for inserting material to be compacted into housing 12. Upper inlet portion 24 is an outwardly opening hopper 25 hingeably mounted in access door 14 adjacent to lower main portion 22 by a piano hinge 26. Hopper 25 includes side panels 28, which include rear, upwardly disposed fingers 30 to limit the opening of hopper 25 and form part of an interlock mechanism as described further below.

Access door 14 also includes elongate, vertically disposed, sawtooth retainers 32 mounted longitudinally on the inside wall of lower main portion 22. Sawtooth retainers 32 help hold the material being compacted in compactor 10 in the compacted or bale form even if the compacting pressure is removed from the bale. Access door 14 also includes a handle 34 for opening the door and a pair of spaced-apart outwardly or laterally disposed pins 36 mounted on the free vertical edge of door 14 for latching the door in the closed position, also as will be described further below.

Compactor 10 includes a pair of trays or shelves 38 mounted on the rear walls thereof for holding spools 40 of baling line 42. Baling line 42 could be twine or baling wire or strapping or the like and is used to tie up or bind the bales of waste material compacted by compactor 10. Baling line 42 enters the top of housing 12 through holes 44 and extends downwardly along a back wall 45 of housing 12 and across a bottom wall 46 to exit from the bottom of compactor 12 under access door 14. It will be noted that back wall 45 also has sawtooth retainers 32 attached thereto for helping to hold a compacted bale in the compacted configuration. However, all of the sawtooth retainers could be eliminated if desired.

Compactor 10 also includes a transverse platen 48 which moves up and down as seen in FIG. 2 along a longitudinal path in housing 12 from a retracted position as seen in FIG. 1 to an extended position as seen in FIG. 2. Platen 48 has notches 146 formed therein at the front and back to accommodate sawtooth retainers 32.

Referring next in particular to FIGS. 1 to 4, compactor 10 includes a latch mechanism 50 mounted on housing 12 for releasably retaining access door 14 closed. Latch mechanism 50 includes a hook member 52 pivotally mounted on housing 12 by a pivot pin 54. Hook member 52 has a forward hook 56 which catches pins 36 on access door 14 to retain door 14 in a closed position while hook member 52 is in the horizontal position as seen in FIGS. 1 to 4. A handle 58 is attached to hook member 52, so that when handle 58 is lifted upwardly, pin 36 is released from hook member 52 and door 14 can be opened. It will be appreciated from FIGS. 1 and 2 that latch mechanism 50 actually includes upper and lower units linked together by a pivoting link 60, so that as handle 58 is lifted, both the upper and lower portions of latch mechanism 50 release their respective pins 36 allowing door 14 to open.

An interlock means is provided by way of an L-bracket 62 mounted on access door inlet portion 24. As seen best in FIG. 3, L-bracket 62 engages the underside of hook member 52 when hopper 25, or the upper inlet portion 24 of hopper door 14, is closed. This prevents the hook member 52 from being able to pivot downwardly or the lifting of handle 58, and thus prevents access door 14 from opening unless inlet portion 24 or hopper 25 is opened as indicated in FIG. 4.

Figure 6:
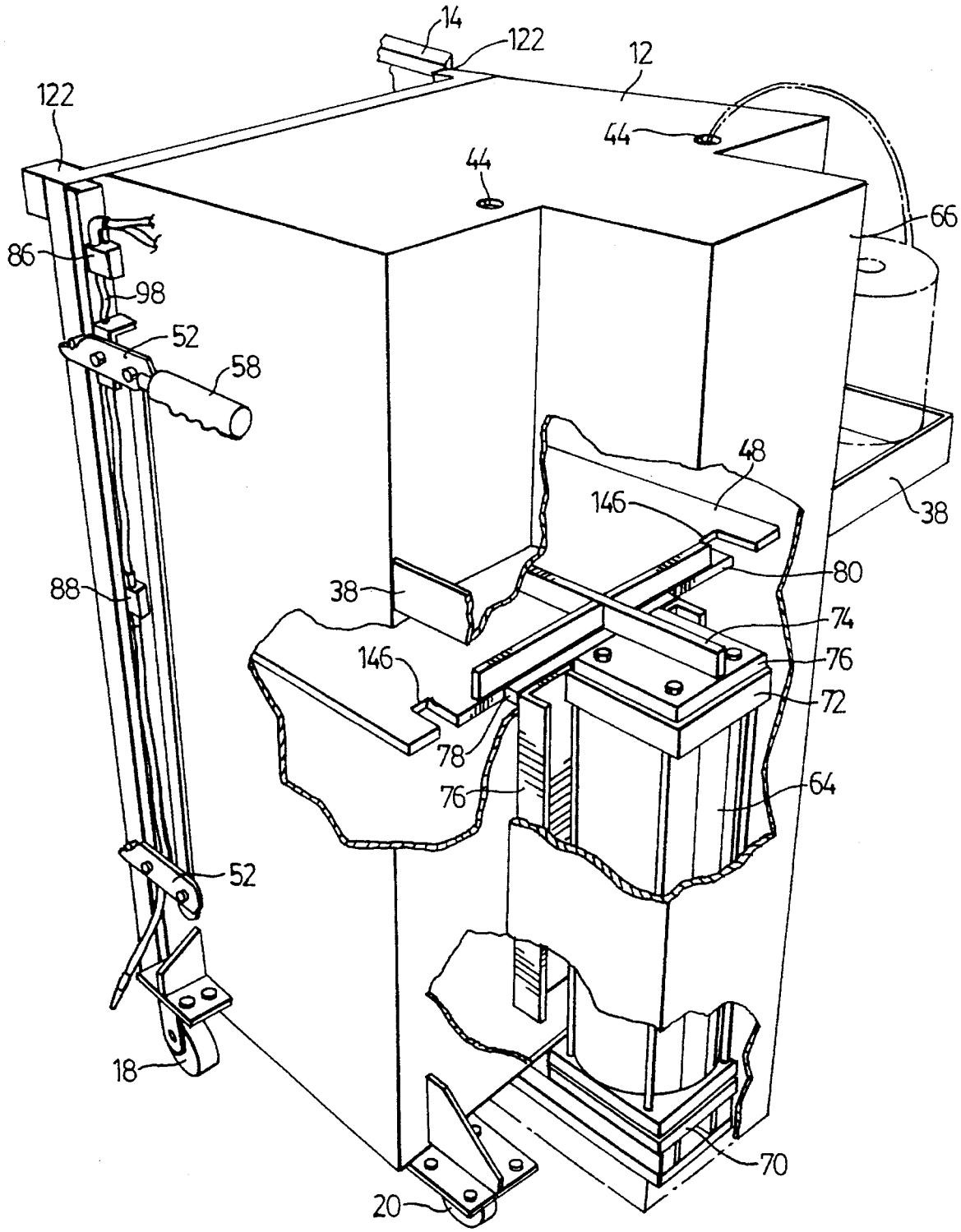
FIG. 6 is a perspective view, partly broken away, of the compactor of FIG. 1 looking toward the rear and left side.
Figure 7:
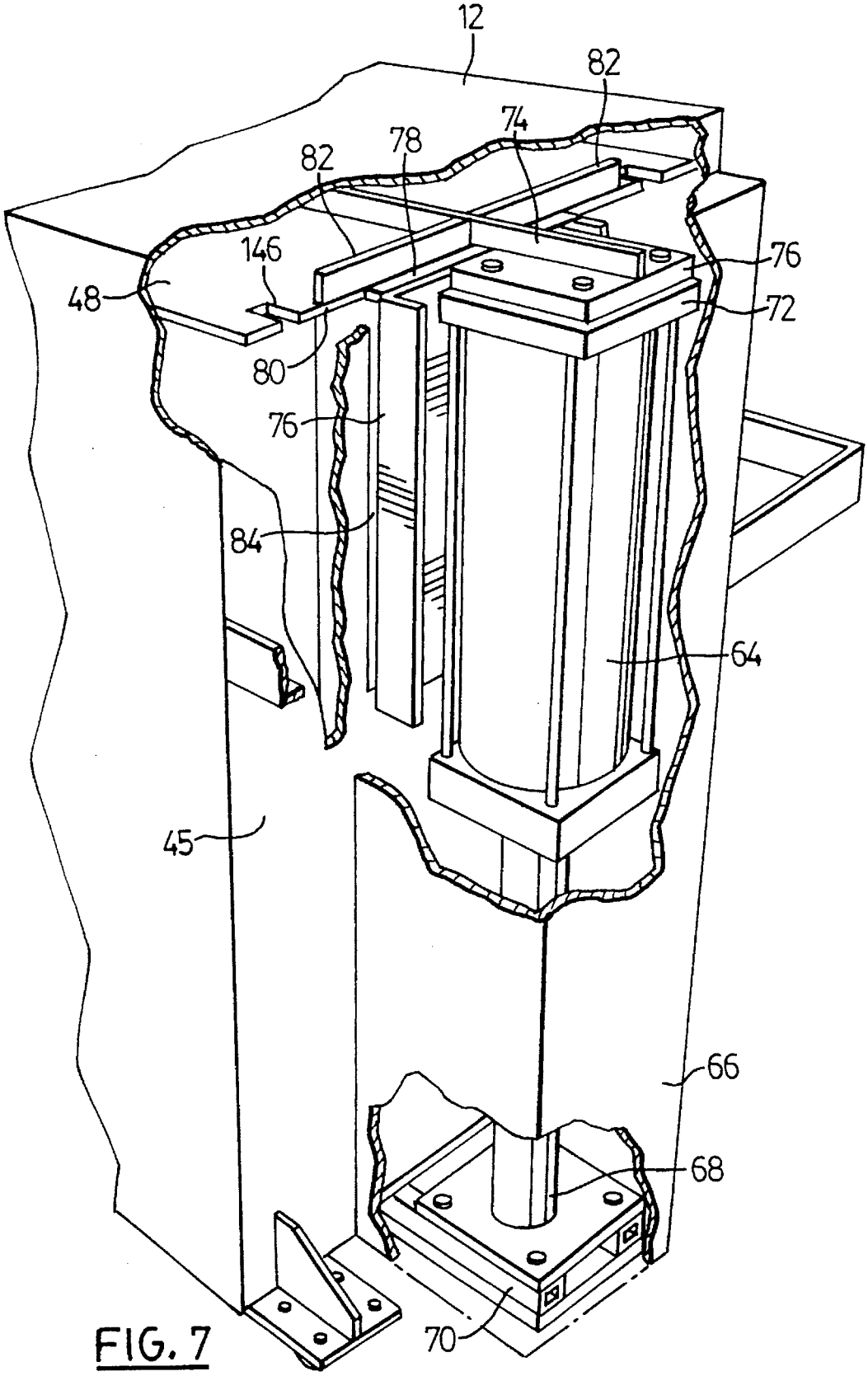
FIG. 7 is a perspective view, partly broken away, similar to FIG. 6 but showing the platen in the retracted position.

Referring next to FIGS. 6 and 7, an actuator 64 in the form of a pneumatic cylinder is located in a rear sub-enclosure 66 of housing 12. Actuator 64 is located beside and parallel to the path along which platen 48 moves. Actuator 64 has a first end 68 which is actually the end of the piston shaft of the piston and cylinder forming actuator 64. First end 68 is attached to housing 12 by being bolted in place to a lower plate assembly 70 attached to the bottom wall 46 of housing 12.

Actuator 64 has a second opposed end 72 attached to platen 48 by a cantilevered bracket 74 transversely mounted to both platen 48 and the cylinder second end 72. Cantilevered bracket 74 is welded to platen 48 and attached to a cylinder second end 72 by a plate 76 bolted to the cylinder.

Guide means is provided for guiding the movement of platen 48 along its vertical, longitudinal path in housing 14. This guide means includes a guide plate 76 in the form of a length of steel channel attached through a spacer 78 to the rear edge portion 80 of platen 48. Guide plate 76 slides on the rear surface of back or rear wall 45 of housing 12 to prevent actuator 64 from tilting forwardly or in the direction of platen 48. It will be appreciated that guide plate 76 could be attached to cantilevered bracket 74 or to the cylinder of actuator 64, as desired. The guide means also includes the rear edge portion 80 of platen 48 which slides along the inside surface or side of back wall 45. This prevents the cylinder of actuator 64 from tilting rearwardly especially when platen 48 is under load. Since the frictional force of platen 48 against rear wall 45 is much higher when platen 48 is under load, extra transverse bars 82 are attached to the rear edge portion 80 of platen 48 to spread the load.

Rear wall 45 includes a longitudinal slot 84 through which cantilevered bracket 74 passes allowing platen 48 to move up and down. When platen 48 is in the upper position, guide plate 76 fills slot 84 to prevent the material being compacted from passing into sub-enclosure 66 and interfering with the operation of actuator 64. As seen best in FIG. 7, spacer 78 is slightly shorter in length and the width of slot 84, so spacer 78 slides along slot 84 preventing actuator 64 and a platen 48 from moving from side to side.

Referring next in particular to FIGS. 2 to 6, compactor 10 is provided with a pair of safety switches in the form of respective upper and lower pneumatic control valves 86, 88. Lower control valve 88 is a normally open valve and has a forwardly disposed plunger 90 (see FIG. 5) which is engaged by frame 92 of access door 14, so that when access door 14 is closed, lower control valve 88 is activated and opens. Control valve 88 communicates or is coupled to an air inlet line 94 having a standard quick-disconnect fitting 96. Lower control valve 88 is connected in series through a connecting line (not shown) to upper control valve 86, so that when access door 14 is closed, pressurized air is supplied to upper control valve 86.

Figure 3:
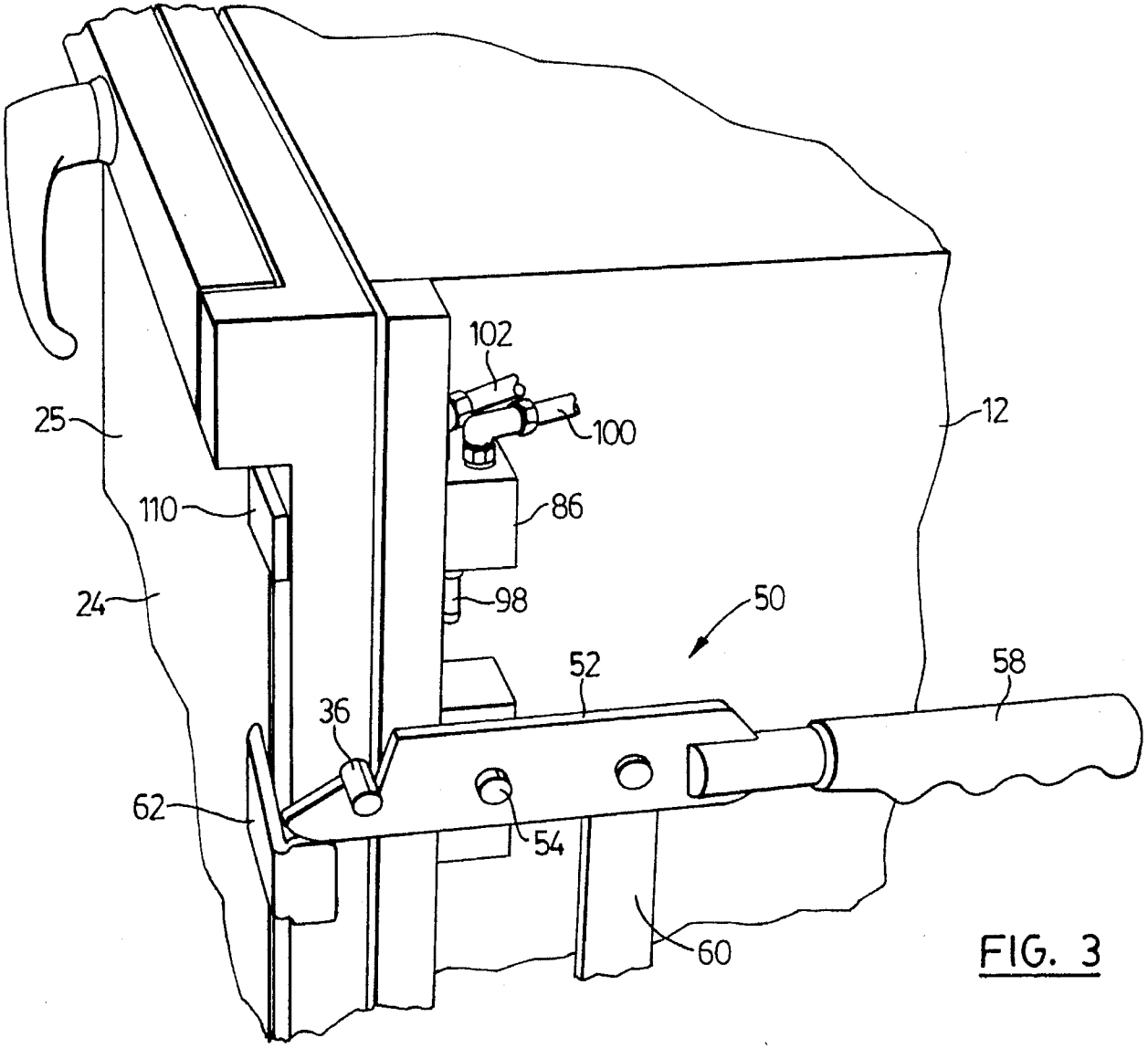
FIG. 3 is an enlarged perspective view of a portion of the compactor of FIG. 1 as viewed in the direction of arrow 3 of FIG. 1.
Figure 4:
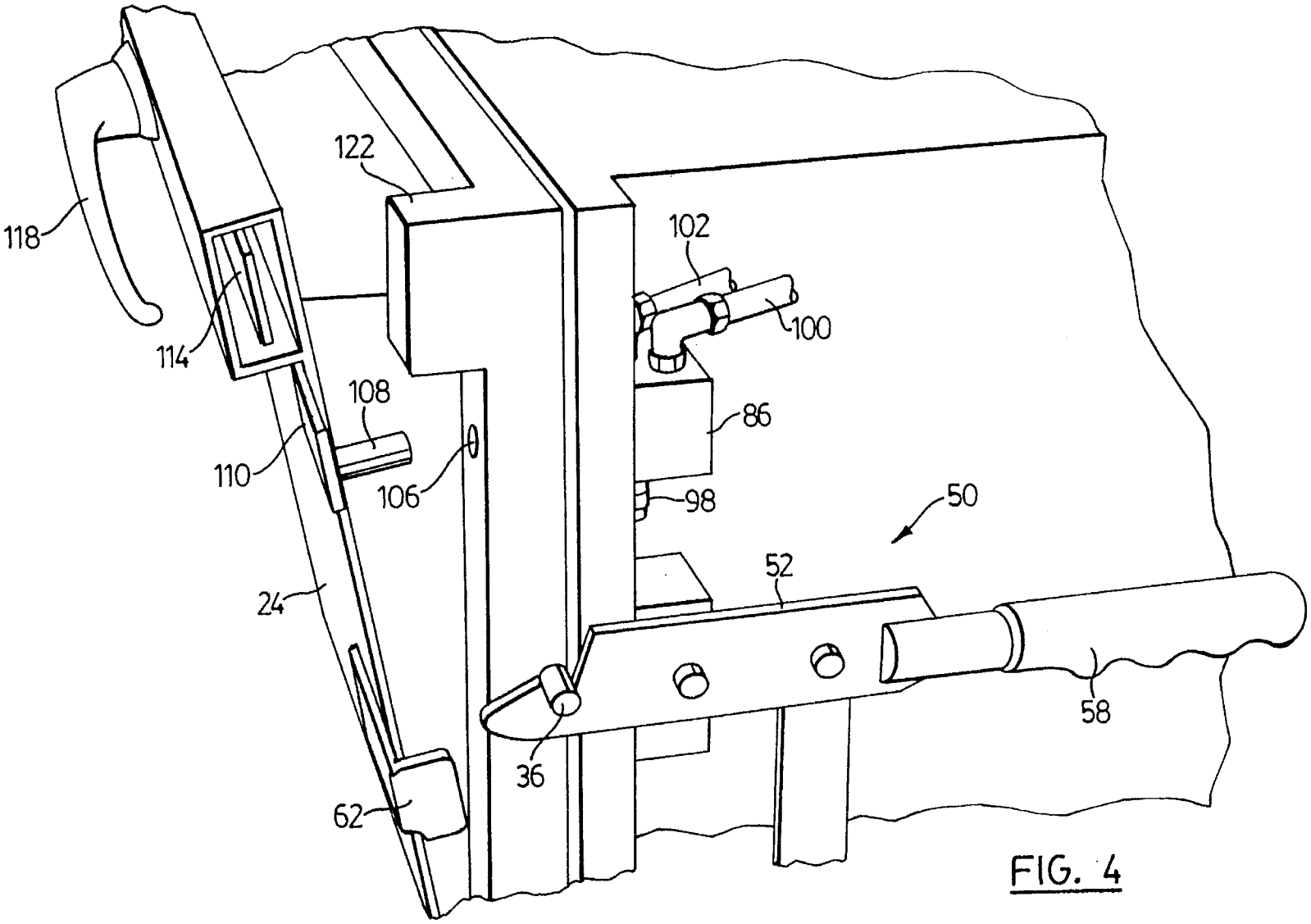
FIG. 4 is a perspective view similar to FIG. 3, but showing the hopper door partially open.
Figure 5:
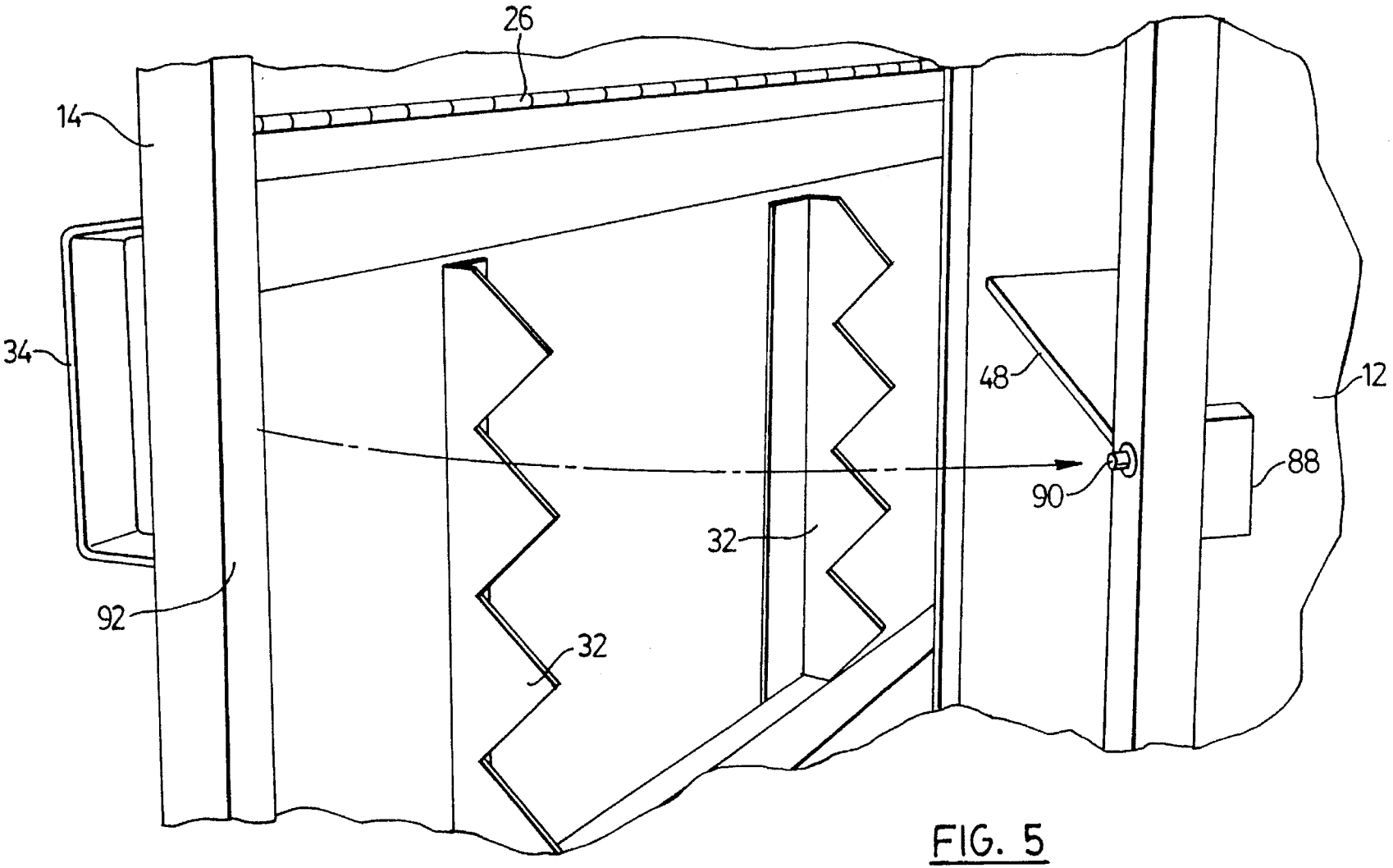
FIG. 5 is an enlarged perspective view of a portion of the compactor of FIG. 1 taken in the direction of arrow 5 of FIG. 1, but showing the access door partially open.

As seen best in FIGS. 2, 3 and 4, upper control valve 86 is a four-way valve having an inlet 98 and two outlets 100, 102. Control valve 86 also has a forwardly disposed plunger 104 which fits into or is accommodated by a hole 106 formed in the frame 92 of access door 14. Plunger 104 is activated by a rearwardly disposed finger or rod 108 mounted on a bracket 110 attached to access door upper inlet portion 24. When inlet portion 24 or hopper 25 is closed, rod 108 passes through hole 106 and activates upper control valve 86.

Pneumatic cylinder or actuator 64 is a double acting cylinder with the outlet 100 of upper control valve 86 being coupled to cylinder 64 to cause it to move in one direction, and the outlet 102 of control valve 86 being coupled to cylinder 64 to cause it to move in the reciprocal or opposite direction. These connections are made so that when hopper 25 or upper inlet portion 24 is closed causing control valve 86 to be activated, actuator or cylinder 64 moves downwardly causing platen 48 to move downwardly compressing or compacting material inside compactor 10. When the hopper or access door inlet portion 24 is opened, control valve 86 is deactivated causing the pressurized air supply to be supplied to cylinder 64 causing it and the platen 48 to move upwardly.

Figure 11:
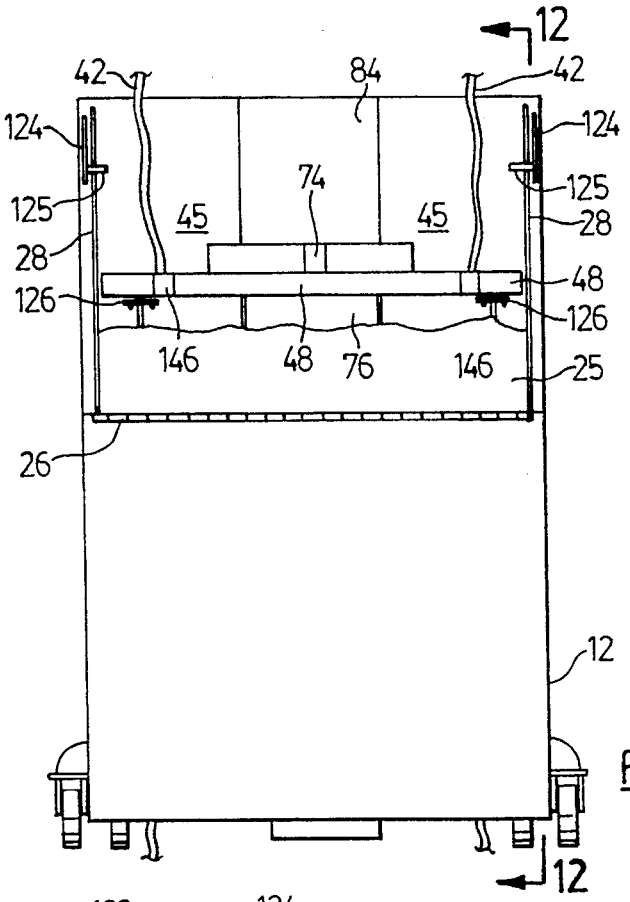
FIG. 11 is a front view of the compactor of FIG. 1 with the hopper door partly broken away.
Figure 12:
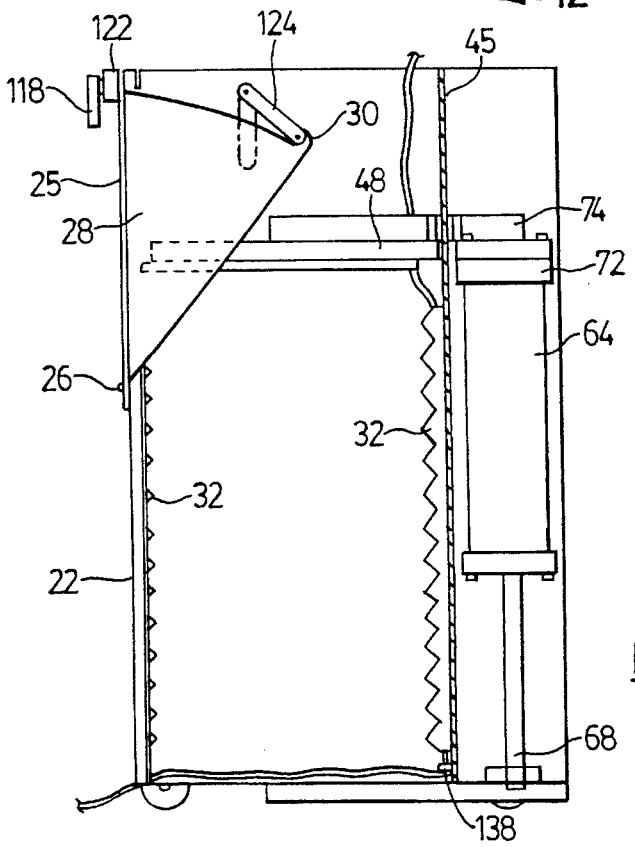
FIG. 12 is a vertical sectional view taken along lines 12—12 of FIG. 11.
Figure 13:
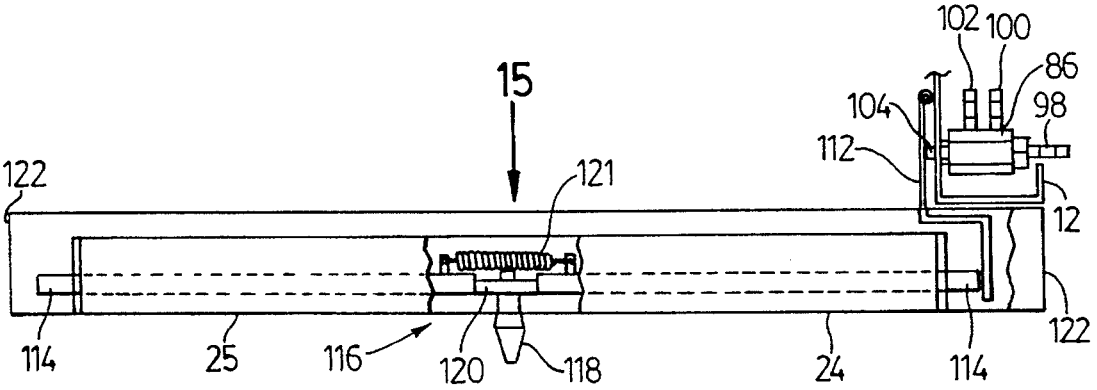
FIG. 13 is a plan view, partly broken away of the hopper door lock mechanism.
Figure 14:
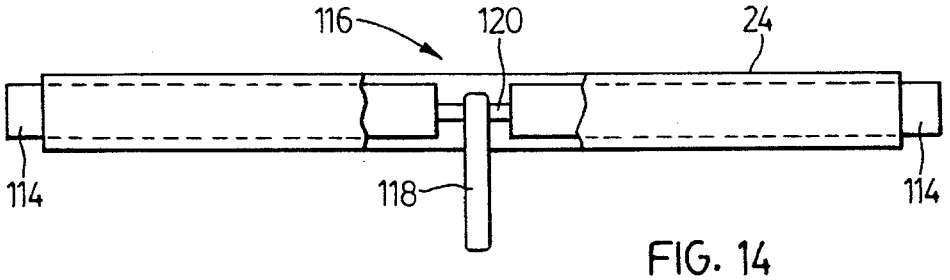
FIG. 14 is a front view a portion of the mechanism shown in FIG. 13.
Figure 15:
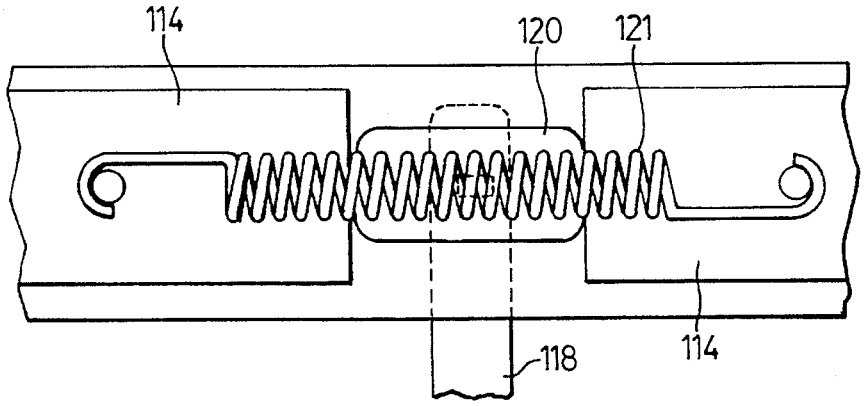
FIG. 15 is an enlarged elevational view of a portion of the locking mechanism as viewed in the direction of arrow 15 of FIG. 13.
Figure 16:
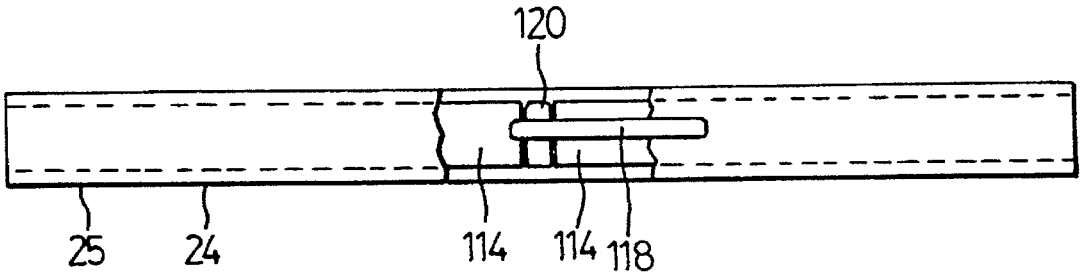
FIG. 16 is an elevational view similar to FIG. 14, but shown the mechanism in the unlocked position.
Figure 17:
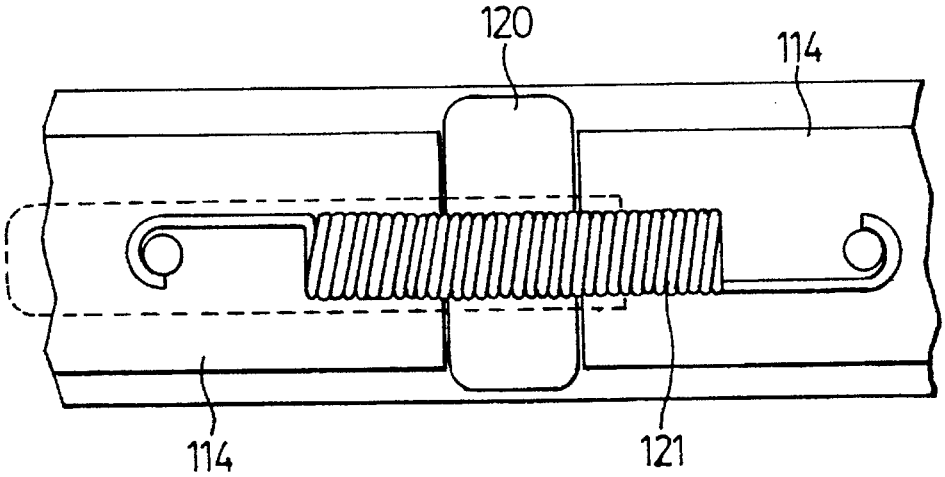
FIG. 17 is an enlarged elevational view similar to FIG. 15, but showing the locking mechanism in the unlocked position.

FIGS. 11 through 17 show a preferred modification whereby hopper 25 cannot be opened until platen 48 is in its uppermost or retracted position. As seen best in FIG. 13, upper control valve 86 is re-orientated, so that plunger 104 extends inwardly and is activated by a hinged, off-set bracket 112. Off-set bracket 112 is in turn activated by a reciprocating bolt 114 forming part of a door lock closure mechanism 116 for hopper 25 or access door upper inlet portion 24. Door lock closure mechanism 116 includes a handle 118 which operates a cam 120, which in turn causes bolts 114 to retract and extend. A spring 121 urges bolts 114 together into the retracted position. When bolts 114 are retracted as seen in FIG. 16, hopper 25 or door inlet portion 24 can be opened, and when bolts 114 are extended as seen in FIGS. 13 and 14, the ends of bolts 114 are retained in hollow blocks 122 forming part of the frame of access door 14, thereby preventing hopper 25 from opening. As mentioned above, when bolts 114 are in the extended position, so that hopper 25 or inlet portion 24 is locked closed, upper control valve 86 is activated and this causes cylinder 64 and platen 48 to descend and start the compacting cycle. When the hopper door is unlocked by turning handle 118, upper control valve 86 is de-activated causing cylinder or actuated 64 to extend and raise platen 48.

Referring next to FIGS. 11 and 12, a further safety feature is illustrated in the form of an inlet portion or hopper interlock, whereby a pair of pivoting links 124 is mounted on the inside sidewalls of housing 12 between the side walls and the side panels 28 of hopper 25. Pivoting links 124 include engagement pins 125 which engage fingers 30 on hopper side panels 28 as seen best in FIG. 12, to prevent hopper 25 from being opened. When platen 48 raises to the uppermost position, platen 48 engages engagement pins 125 raising pivoting links 124, thereby releasing the hopper interlock and allowing hopper 25 to be opened fully. Hopper 25 cannot be opened until platen 48 is in the fully raised or near fully raised position.

Figure 8:
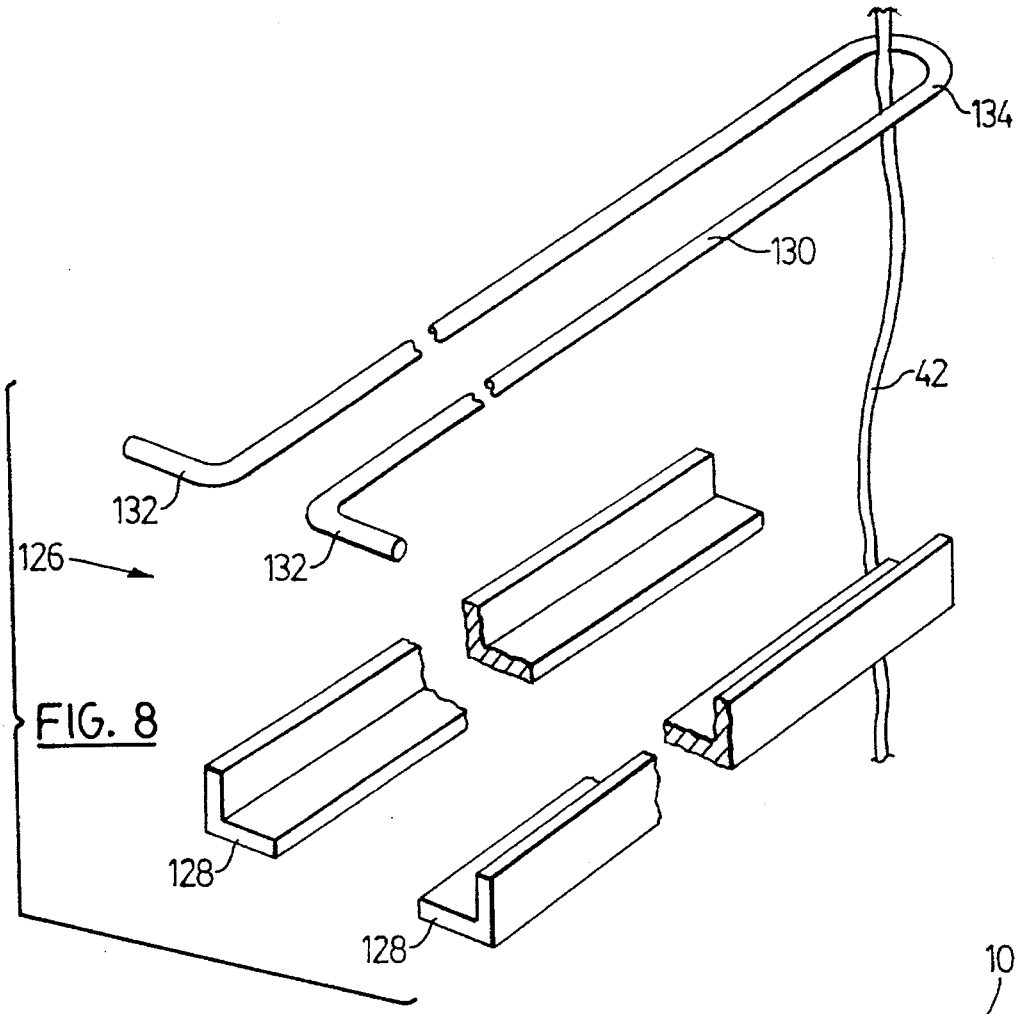
FIG. 8 is an enlarged, perspective, exploded view of the baling line puller assembly used in the compactor of FIG. 1.
Figure 10:
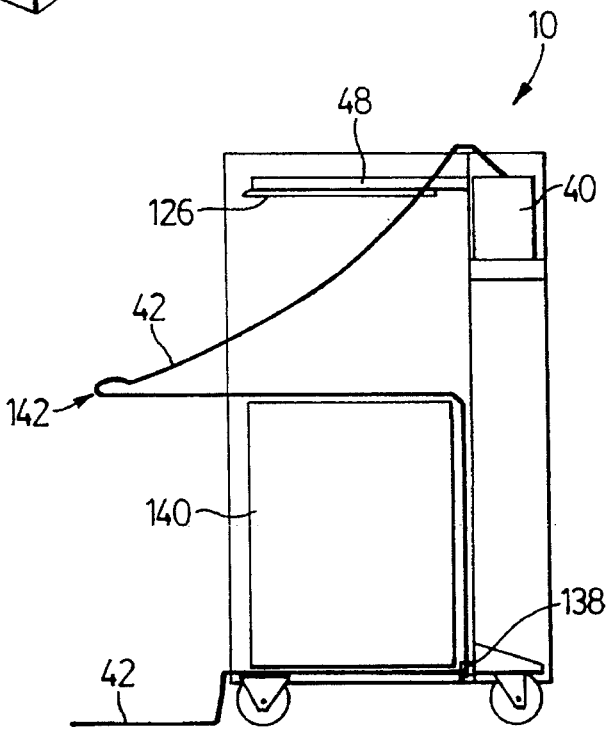
FIG. 10 is a schematic, vertical sectional view of the compactor illustrating the method of tying a bale with baling twine or wire.

Referring next to FIGS. 8 and 10, baling line pullers 126 are mounted on the underside of platen 48 in a parallel, spaced-apart arrangement. Baling line pullers 126 include elongate channels 128 and a U-shaped puller element 130 slidably mounted in the space between channels 128. Puller elements 130 have transverse finger grips 132 which are located adjacent to the forward edge of platen 48 and adjacent to access door 14. Puller elements 130 also have U-shaped distal end portions 134 which are adapted to capture or have baling line 42 pass therethrough. As seen best in FIG. 2, the baling line 42 passes through notches 146 in platen 48 then through puller elements 130 and down through spring-loaded L-hooks 138 and then out through the bottom of housing 14. When a bale of waste material has been compacted, such as bale 140 in FIG. 10, puller elements 130 are pulled outwardly so that the baling line can be grasped and cut at 142. The free end is then tied together with baling line 42 coming out of the bottom of compactor 10. It will be appreciated that channels 128 allow puller elements to slide outwardly even if platen 10 is pressed against bale 140, so the baling line can be cut and tied while the bale is still being compressed. Spring-loaded L-hooks 138 also allow the baling line to be released as it is being pulled tightly against the bale.

Figure 9:
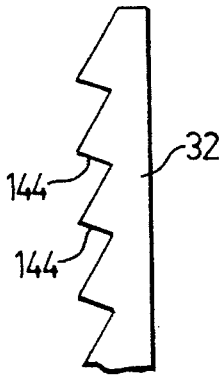
FIG. 9 is a side view of another embodiment of a sawtooth retainer as used in the present invention.

FIG. 9 shows an alternative sawtooth form for sawtooth retainers 32 where the teeth undersides 144 are disposed at an angle which is more perpendicular to the upper movement of a compacted bale pressing thereagainst.

The operation of the embodiments thus far described will now be described. Access door 14 is normally closed. When it is desired to compact waste material such as paper, plastic sheeting or rags, handle 118 on hopper 25 is turned and the hopper is swung open as indicated in FIG. 1. Waste material is then inserted into compactor 10 and hopper 25 is again closed. When hopper 25 is closed (in the FIG. 4 embodiment), or when handle 18 is turned to lock hopper 25 in the closed position (in the FIG. 13 embodiment), upper control valve 86 is activated causing actuator 64 to be activated and in turn cause platen 48 to descend to compact the waste material. If all of the waste material that is desired to be compacted is already in compactor 10, hopper handle 18 can be turned, or hopper 25 opened if interlock 124, 126 is not provided, and upper control valve 86 is deactivated causing actuator 64 and platen 48 to rise to the uppermost position. At this point, access door 14 can be opened by releasing latch mechanism 50. The bale can be tied up using baling line 42 and removed from compactor 10. Alternatively, the cycle can be repeated to make the bale larger.

If desired, control valves 86, 88 can be operated manually with access door 14 open causing platen 48 to descend and again compress the bale. Baling line pullers 126 can then be used to pull out baling line 42 and tie up bale 140 while it is still under compression by platen 48. Releasing control valves 86, 88 would then cause platen 48 to retract and allow bale 140 to be removed from compactor 10.

Figure 18:
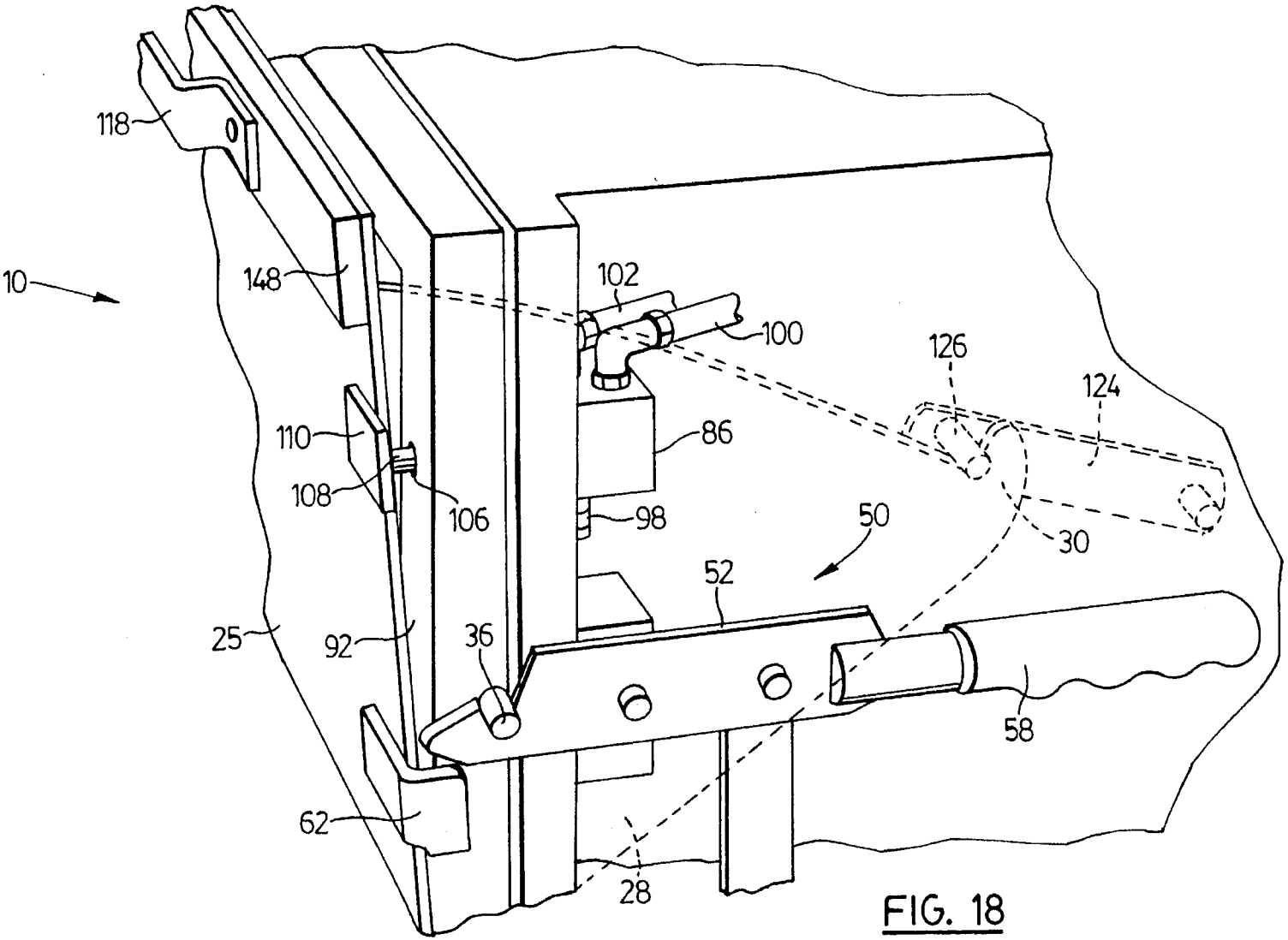
FIG. 18 is a perspective view, similar to FIG. 4, but showing yet another embodiment of the hopper door and switch actuating mechanism.

Referring next to FIG. 18, another embodiment of compactor 10 is shown which is somewhat simplified. In this embodiment, the door lock closure mechanism 116 of FIGS. 13 to 17 has been replaced by a simple reinforcing bar 148 and a plain pull handle 118. Control valve 86 is orientated as shown in FIG. 2. Pivoting link 124 has also been re-located and arranged so that hopper door 25 can be opened slightly (approximately one centimeter) to an ajar position, before finger 30 engages engagement pin 125. This slight opening, however, is enough to deactivate upper control valve 86 and cause platen 48 (not shown in FIG. 18) to rise. When platen 48 reaches the uppermost position to engage and lift pin 125 and pivoting link 124, hopper door 25 can be opened fully.

Upper control valve 86 has a spring-loaded plunger which acts against rod 108 to urge or bias hopper door 25 into the partially open or ajar position as shown in FIG. 18. An operator must push against hopper door 25 to close it and thus activate control valve 86 to cause platen 48 to descend. It usually takes about 5 to 7 seconds for platen 48 to descend to its lowermost or compacting position, and as soon as the operator lets go of hopper door 25, the platen automatically rises no matter what position it is in.

Having described preferred embodiments, it will be appreciated that various modifications may be made to the structures described above. For example, actuator 64 has been described as a pneumatic cylinder and piston. Actuator 64 could be hydraulic, or it could be replaced with an electric motor and a rack end pinion or worm gear mechanism, as desired. In the case of an electrically driven compactor, control valves 86, 88 would be replaced with electric switches. Compactor 10 has been shown to be an upright machine. It could be disposed horizontally with suitable modifications to access door 14 and hopper 25. If sawtooth retainers 32 are eliminated, platen 48 would not have notches 146. The baling line and line pullers could be eliminated, as could all of the interlocking mechanisms. Other types of guide means could be provided for guiding the movement of platen 48 along its desired path. Access door upper inlet portion 24 does not have to be a hopper. It could be a sliding door or hinged at the side or top.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

What is claimed is:

1. A compactor comprising:

an elongate housing including an access door;

a transverse platen located in the housing;

guide means coupled to the platen for guiding the movement of the platen along a longitudinal path in the housing from a retracted position, past said access door to an extended position, whereby material inserted into the housing through the access door is compacted by the platen; and an actuator located in the housing beside and parallel to said path of movement of the platen, the actuator including a piston and a cylinder, the piston having a first end attached to the housing and the cylinder including a second opposed end attached to the platen, said cylinder being slidably disposed on the piston whereby the platen is reciprocated by the movement of the cylinder between an upper position where said piston is substantially withdrawn from the cylinder and a lower position where said piston is retracted into said cylinder and supported by said cylinder.

2. A compactor as claimed in claim 1 wherein the housing has back and bottom walls, and further comprising: means for feeding baling line down the back and across the bottom walls and out of the housing below the access door; an elongate, channel mounted on the underside of the platen extending toward and adjacent to the access door; and an elongate baling line puller element slidably mounted in said channel, where said baling puller element is not connected to said access door, the puller having a distal end portion adapted to capture the baling line to be used to pull same out of the housing when the access door is opened.

3. A compactor as claimed in claim 2 wherein said feeding means, channel and puller element for a first baling line puller assembly, and further comprising a second identical being line puller assembly spaced from and mounted parallel to said first assembly.

4. A compactor as claimed in claim 1 wherein said cylinder is attached to the platen by aa cantilevered bracket transversely mounted to both the platen and the cylinder second end.

5. A compactor as claimed in claim 4 wherein the housing includes a rear wall including a longitudinal slot adapted to accommodate the cantilevered bracket therein for movement therealong upon actuation of the actuator.

6. A compactor as claimed in claim 5 wherein the guide means includes a rear edge portion of the platen adapted to slide along one side of said rear wall.

7. A compactor as claimed in claim 6 wherein the guide means further includes a guide plate adapted to slide along an opposite side of said rear wall, the guide plate being attached to one of the platen, the cantilevered bracket and the cylinder.

8. A compactor as claimed in claim 1 wherein the access door includes a lower main portion, and an upper inlet portion for inserting material into the housing.

9. A compactor as claimed in claim 8 and further comprising elongate sawtooth retainers mounted longitudinally inside the housing to engage compacted material in the housing.

10. A compactor as claimed in claim 8 wherein the upper inlet portion is an outwardly opening hopper hingeably mounted in the access door adjacent to the lower main portion.

11. A compactor as claimed in claim 8 and further comprising a pair of safety switches mounted on the housing and operatively coupled in series to the actuator, a first one of said switches being located adjacent to and activated by the closure of said access door main portion, a second one of said switches being located adjacent to the access door inlet portion, and a door lock closure mechanism mounted on the access door inlet portion to lock said inlet portion in a closed position, said mechanism including a bolt being operatively coupled to said second switch to activate said switch upon the closure and locking of said inlet portion.

12. A compactor as claimed in claim 11 wherein the actuator is a pneumatic piston and cylinder, the piston including said first end attached to the housing and the cylinder including said second end attached to the platen and wherein the safety switches are pneumatic valves.

13. A compactor as claimed in claim 11 and further comprising a latch mounted on the housing for releasably retaining the access door main portion closed, and an interlock means mounted on the access door inlet portion to engage and disable the latch when the inlet portion is closed, thereby preventing the main portion from opening unless the inlet portion is opened.

14. A compactor as claimed in claim 13 wherein said second switch is a four-way switch, whereby the four-way switch causes the actuator to move the platen to the extended position upon the bolt activating the second switch and to move the platen to the retracted position upon the bolt de-activating the second switch.

15. A compactor as claimed in claim 14 and further comprising an interlock means adapted to engage and prevent the opening of the access door inlet position upon closure of said inlet portion, said interlock means including a release pin adapted to be engaged by the platen when the platen is in the retracted position.

16. A compactor as claimed in claim 8 and further comprising a pair of safety switches mounted on the housing and operatively coupled in series to the actuator, a first one of said switches being located adjacent to and operated by said access door main portion and a second one of said switches being located adjacent to and operated by said access door inlet portion, both of said switches being activated to operate the actuator and cause the platen to move to the extended position.

17. A compactor as claimed in claim 11 and further comprising a latch mounted on the housing for releasably retaining the access door main portion closed, and an interlock means mounted on the access door inlet portion which is adapted to engage and disable the latch when the inlet portion is closed, thereby preventing the main portion from opening unless the inlet portion is opened and thereby disabling the latch when said inlet portion is closed.

18. A compactor as claimed in claim 16 wherein the actuator is a pneumatic piston and cylinder, the piston including said first end attached to the housing and the cylinder including said second end attached to the platen and wherein the safety switches are pneumatic valves.

19. A compactor as claimed in claim 16 wherein said second switch is a four-way switch, whereby the four-way switch causes the actuator to move the platen to the retracted position upon the opening of the access door inlet portion, and to move the platen to the extended position upon the closure of the access door inlet position.

20. A compactor as claimed in claim 19 and further comprising an upper inlet portion interlock including a pivoting link mounted in the housing and adapted to engage and prevent the opening of the upper inlet portion, and said link including an engagement pin disposed to be operatively engaged by the platen in the retracted position to release said interlock.

21. A compactor as claimed in claim 20 wherein said pivoting link is located in the housing such that the upper inlet portion is allowed to open to an ajar position sufficient to de-activate the second switch causing the platen to move to the extended position.

22. A compactor as claimed in claim 21 and further comprising means to bias the upper inlet portion into said ajar position.

* * * * *